United States Patent [19]

Plazanet

[11] Patent Number: 4,999,871

[45] Date of Patent: Mar. 19, 1991

[54] DEVICE FOR FIXING A FIBROUS MATERIAL PAD AND A SURFACE CLEANING MACHINE EQUIPPED WITH SAID DEVICE

[76] Inventor: Maurice P. Plazanet, 34 avenue Jean Racine, 92330 Sceaux, France

[21] Appl. No.: 359,998

[22] Filed: Jun. 1, 1989

[30] Foreign Application Priority Data

Jun. 16, 1988 [FR] France ..... 88 08070

[51] Int. Cl.[5] ..... A47L 11/14

[52] U.S. Cl. ..... 15/230.17; 15/98; 15/147 A; 15/228; 15/257 R

[58] Field of Search ..... 15/98, 230.17, 230, 15/246, 257 R, 147 R, 147 A, 209 D, 228; 51/358, 388; 24/710.8; 16/6, 8; 428/100

[56] References Cited

U.S. PATENT DOCUMENTS

| | | | |
|---|---|---|---|
| 989,962 | 4/1911 | Hall | 24/710.8 |
| 3,527,001 | 9/1970 | Kleemeier et al. | 15/230.17 |
| 4,407,040 | 10/1983 | Scharf | 15/230.17 |
| 4,455,705 | 6/1984 | Graham | 15/230.17 |

*Primary Examiner*—Edward L. Roberts

*Attorney, Agent, or Firm*—Marshall, O'Toole, Gerstein, Murray & Bicknell

[57] ABSTRACT

A fibrous material pad fixing device is provided, comprising assemblies of pairs of metal hooks fixed to a support, the hooks of each pair being opposite each other. The invention applies more particularly to fixing a cleaning disc on a surface cleaning machine.

11 Claims, 3 Drawing Sheets

Fig: 5
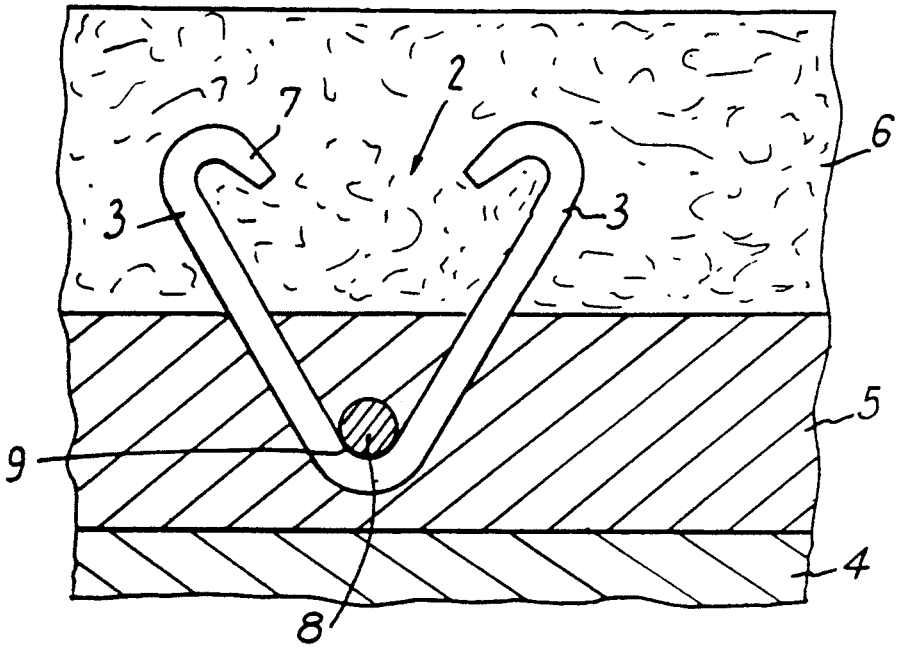
Fig: 6
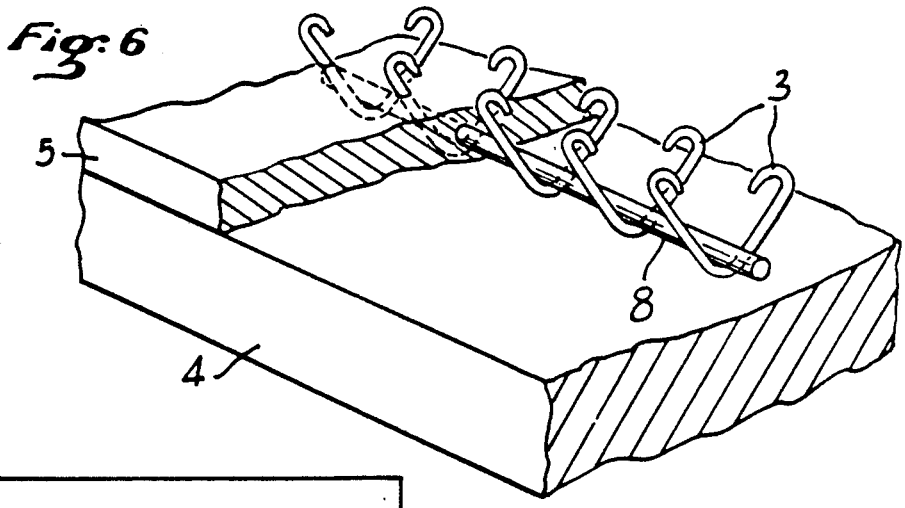
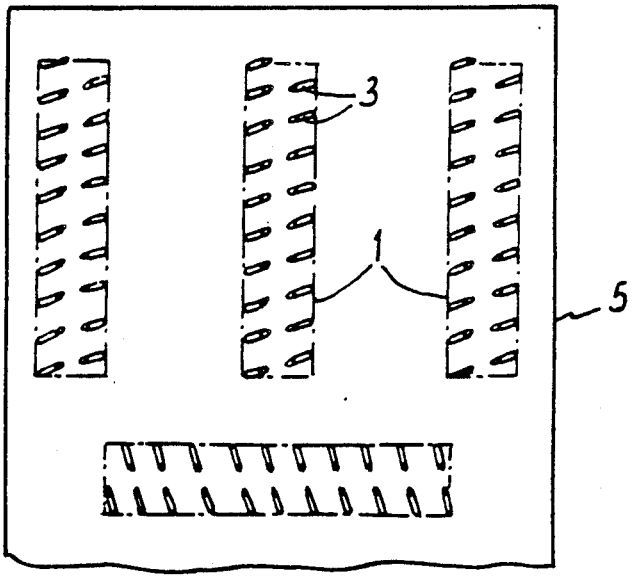
Fig: 7

DEVICE FOR FIXING A FIBROUS MATERIAL PAD AND A SURFACE CLEANING MACHINE EQUIPPED WITH SAID DEVICE

BACKGROUND OF THE INVENTION

The present invention relates to a disc for fixing a fibrous material pad, as well as a surface cleaning machine equipped with said device.

More particularly, but not exclusively, the invention applies to fixing a reciprocating support or rotary cleaning disc made from a fibrous material in a surface cleaning machine. Up to now, for this, a large number of synthetic material points or barbs have been used distributed over a support, having a shape corresponding to that of the cleaning disc, in various slanted positions with respect to said support. This solution is not entirely satisfactory. In fact, it is not easy to cause the barbs to penetrate into the fibrous material because of their great flexibility and once they have penetrated in the fibrous material they do not provide absolutely efficient fixing of the cleaning disc and this latter, when operating, i.e. rotating at high speed, risks coming off the support. Furthermore, the progressive clogging up of the disc, after a more or less extended use, generally makes the penetration of the barbs into the fibrous material even more difficult, when said disc is turned over in order to use the clean face.

SUMMARY OF THE INVENTION

The purpose of the present invention is to avoid these drawbacks and relates to a device for fixing a fibrous material pad, by means of which device, whether the pad belongs to a cleaning utensil or whether it forms a rotary disc of a surface cleaning machine, it may be readily and firmly fixed to a support even should said pad be clogged up.

For this, the fibrous material fixing support is remarkable, in accordance with the invention, in that it comprises assemblies of pairs of metal hooks fixed to a support, the hooks of each pair being opposite each other.

This particular arrangement of the hooks, which may readily penetrate into the fibrous material, guarantees better fixing of the pad, even when considerable forces are applied thereto, as in the case in a rotary disc surface cleaning machine.

Advantageously, said assemblies are rectilinear.

According to other characteristics of the invention, either the hooks of each pair are facing each other or the hooks of an assembly are offset in a staggered arrangement.

In particular, the hooks may be partially embedded in a resin layer provided on said support.

In another characteristic of the invention, each assembly of hooks is formed from a longitudinally cut helical spring.

According to yet another characteristic of the invention, each pair of hooks has a general V shape in which the ends of the legs are curved inwardly.

Advantageously, in this latter case, each assembly of hooks is formed by a plurality of pairs of hooks joined together by a rod fast with the bottom of the V's.

In particular, for fixing a fibrous material surface cleaning disc, the device comprises a support having a discoidal shape corresponding to that of said cleaning disc, on which support assemblies of hooks are provided for hooking said cleaning disc to said support. Advantageously, said hook assemblies are radial.

BRIEF DESCRIPTION OF THE DRAWINGS

The figures of the accompanying drawings will better show how the invention may be put into practice. In these figures, identical references designate similar elements.

FIGS. 5 and 6 illustrate a third embodiment of the hooks of the fixing device of the invention;

FIG. 7 illustrates one example of arranging rectilinear assemblies of pairs of hooks according to the invention;

DESCRIPTION OF THE PREFERRED EMBODIMENTS

Figure 9:
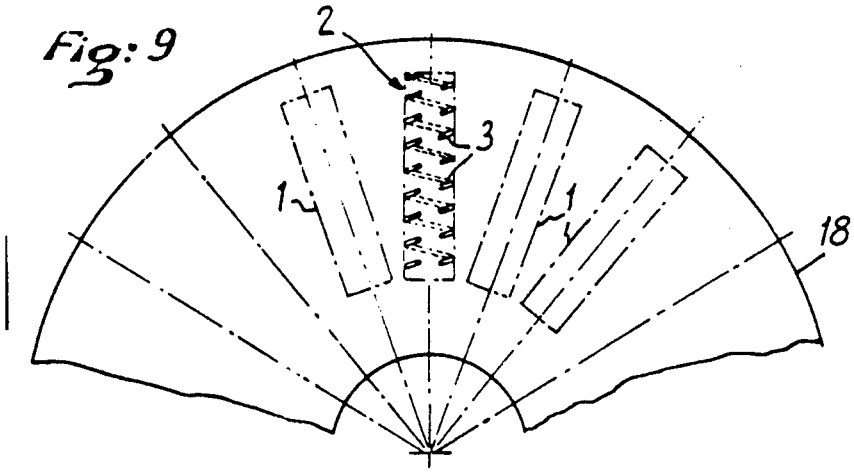
FIG. 9 is a partial top view of a support disc comprising radial assemblies of pairs of hooks according to the invention.
Figure 8:
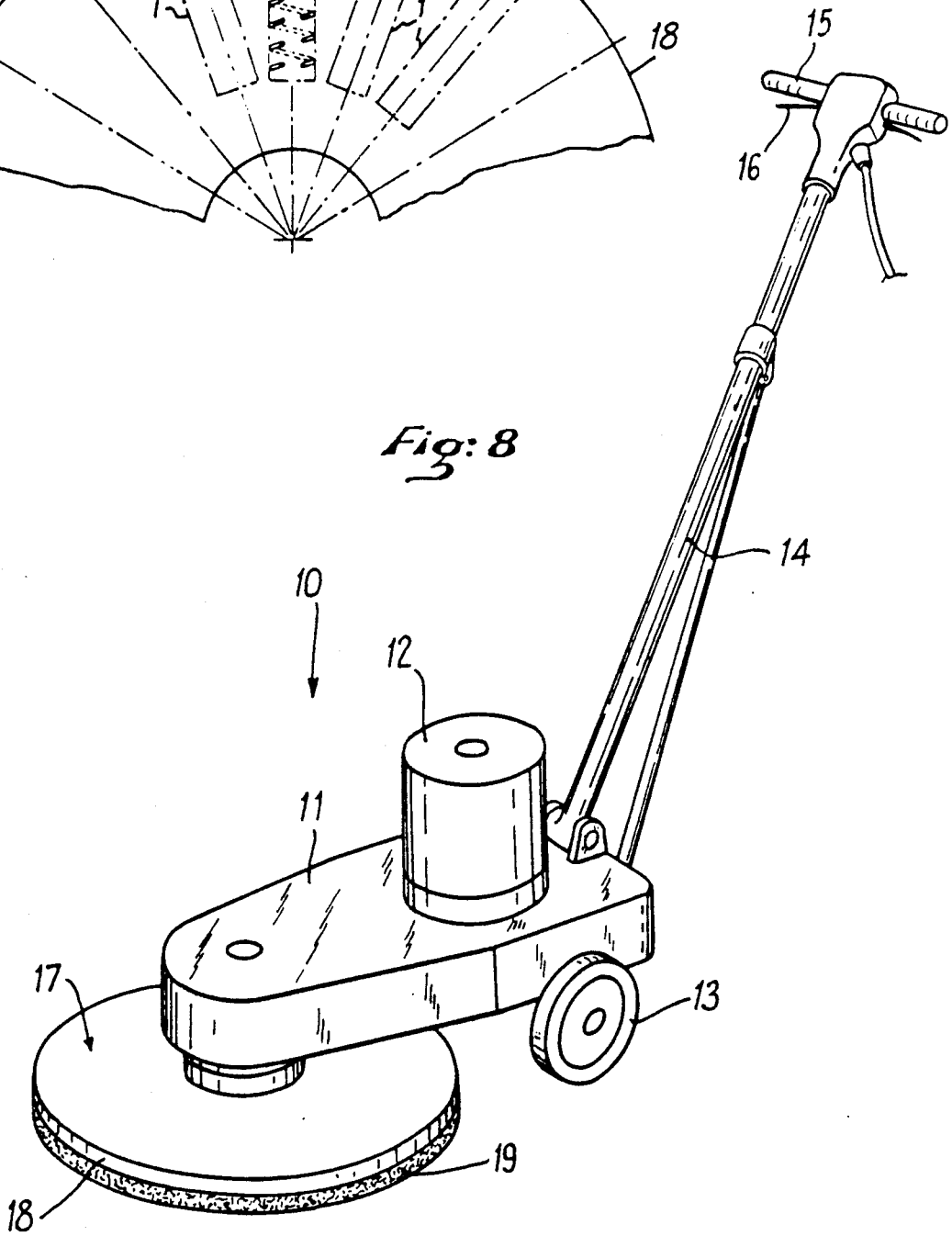
FIG. 8 is a schematic perspective view of a surface cleaning machine which may be equipped with the fixing device of the invention.
Figure 10:
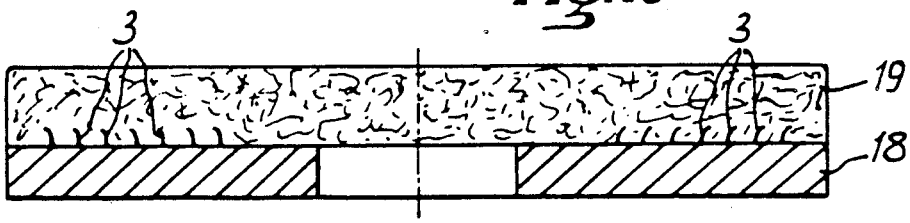
FIG. 10 is a cross sectional view of the disc of FIG. 9.

The Figures of the accompanying drawings illustrate different embodiments of the device for fixing a fibrous material pad in accordance with the invention (FIGS. 1 to 7) as well as the use of such a device in a surface cleaning machine (FIGS. 8 to 10).

Figure 1:
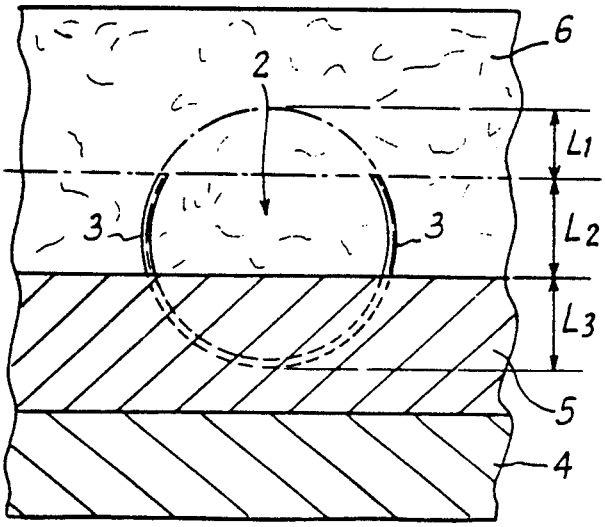
FIGS. 1 and 2 illustrate a first embodiment of the hooks of the fixing device of the invention.
Figure 2:
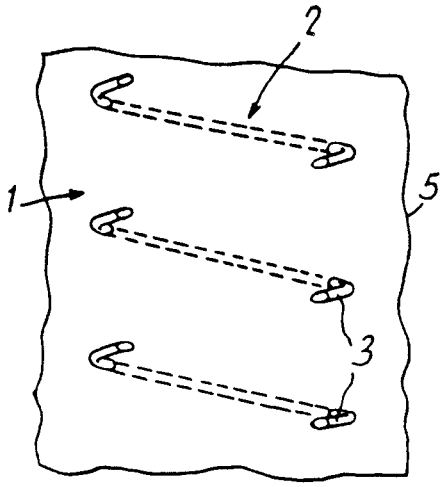
Figure 3:
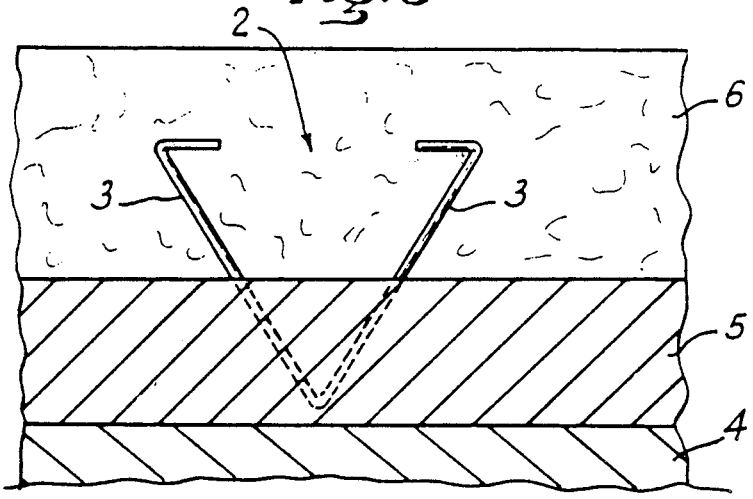
FIGS. 3 and 4 illustrate a second embodiment of the hooks of the fixing device of the invention.
Figure 4:
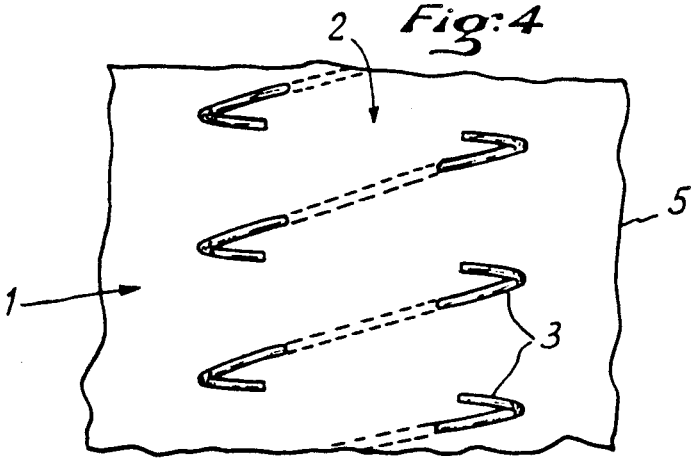

Generally, the fixing device of the invention comprises assemblies 1, particularly rectilinear, of pairs 2 of metal hooks 3 fixed on the support 4, the hooks 3 of each pair 2 being opposite each other. Hooks 3 may be fixed to support 4 by means of a resin layer 5 provided thereon. Hooks 3 make it possible to fix a fibrous material pad 6, as household cleaning utensil, or, as can be seen further on, a rotary disc of a surface cleaning machine. In the first case, FIG. 7 illustrates a possible arrangement of a number of rectilinear assemblies 1 of pairs of hooks 3. Hooks 3 of an assembly 1 may be offset in a staggered arrangement (FIGS. 2 and 4). Each assembly 1 of hooks 3 may then be obtained from a longitudinally cut helical spring (FIGS. 1 and 2), or from a longitudinally cut spring having a triangular cross section (FIGS. 3 and 4). In the first case, as shown in FIG. 1, the cut part L1 of the spirng may correspond, for example, to 2/8 of the "diameter" thereof, part L3 buried in the resin layer and part L2 projecting therefrom, each corresponding to $\frac{3}{8}$ of said diameter. It will be noted that the tops of two opposite hooks may form projections of different heights; furthermore, the cut part L1 of the spring may be cut in a plane slanted with respect to the free surface of layer 5. In the second case, as shown in FIG. 3, a half of the "height" of the spring may be embedded in the resin layer 5, the other half projecting therefrom.

When the hooks are formed into a spring, it can be seen that the combined slants of the pairs of hooks make it possible to react correctly to omni-directional forces.

As shown in FIGS. 5 and 6, another possibility consists in each pair 2 of hooks 3 facing each other to have a general V shape in which the ends 7 of the legs are inwardly curved. In this case, as shown in FIG. 6, each assembly 1 of hooks 3 is formed by a plurality of pairs 2 of hooks 3 connected together by a rod 8 fast with the bottom 9 of the V's.

The surface cleaning machine 10, shown in FIG. 8, comprises a frame 11 on which is mounted a motor 12. Two wheels 13 are disposed on each side of frame 11 at one end thereof. Moreover, a handle 14 equipped with a guide bar 15 and control members 16, is connected to frame 11, on the side thereof where wheets 13 are disposed. Motor 12 is intended to drive a rotary tool 17, possibly provided with a protective cover (not shown).

Tool 17 comprises a support having the shape of a disc 18 to which a fibrous material surface cleaning disc 19, of corresponding shape, is fixed.

The cleaning disc 17 is fixed to support 18 by means of assemblies 1 of hooks 3 advantageously radial and partially buried in support 18 (FIGS. 9 and 10). It will be noted that, in FIGS. 9 and 10, hooks 3 have been shown in accordance with the first embodiment illustrated in FIGS. 1 and 2. However, other shapes of hooks may of course be used in this application, such as those shown in FIGS. 3, 4, and 5,6.

What is claimed is:

1. A device for fixing a fibrous material pad to a support, comprising a plurality of assemblies of metal hooks, each assembly comprising a plurality of pairs of said hooks, said hooks being rigidly fixed to and projecting from said support, the hooks of each pair being opposite each other.

2. The device as claimed in claim 1, wherein said assemblies are rectilinear.

3. The device as claimed in claim 1, wherein the hooks of each pair are facing each other.

4. The device as claimed in claim 1, wherein the hooks of an assembly are offset in a staggered arrangement.

5. The device as claimed in claim 1, wherein the hooks are partially embedded in a resin layer provided on said support.

6. The device as claimed in claim 1, wherein each assembly of hooks is formed from a longitudinally cut helical spring.

7. The device as claimed in claim 1, wherein each assembly of hooks is made from a longitudinally cut spring having a triangular cross section.

8. The device as claimed in claim 1, wherein each pair of hooks has a general V shape in which the ends of the legs are curved inwardly.

9. The device as claimed in claim 8, wherein each assembly of hooks is formed by a plurality of pairs of hooks connected together by a rod fast with the bottom of the V's.

10. A device as claimed in claim 1, in which said fibrous material is a cleaning disc, wherein said support has a discoidal shape corresponding to that of said cleaning disc, on which support said assemblies of hooks are provided for hooking said cleaning disc to said support.

11. The device as claimed in claim 10, wherein said assemblies of hooks are radial.

* * * * *